US006053462A

United States Patent [19]

Latzel

[11] Patent Number: 6,053,462

[45] Date of Patent: Apr. 25, 2000

[54] SUPPORTING FRAME STRUCTURE AND METHOD FOR FORMING THIS FRAME STRUCTURE

[76] Inventor: Michael Latzel, Schleissheimer Strasse 411, 80935 München, Germany

[21] Appl. No.: 08/962,216

[22] Filed: Oct. 31, 1997

[30] Foreign Application Priority Data

Oct. 31, 1996 [DE] Germany ..... 196 45 017

[51] Int. Cl.[7] ..... A47G 23/02; F21V 19/00

[52] U.S. Cl. ..... 248/152; 248/174; 248/176.1; 362/382

[58] Field of Search ..... 248/176.2, 176.1, 248/174, 152, 346.3, 441.1, 459, 300; 40/738, 714; 362/382, 388; D26/138; D8/354; D6/484; 211/135

[56] References Cited

U.S. PATENT DOCUMENTS

| | | | |
|---|---|---|---|
| 1,284,260 | 11/1918 | Doering | 248/174 |
| 3,230,013 | 1/1966 | Morrison et al. . | |
| 4,984,848 | 1/1991 | Scalisi et al. | 248/174 |
| 5,819,453 | 10/1998 | Eichert et al. | 248/174 |

FOREIGN PATENT DOCUMENTS 0175334 3/1986 European Pat. Off. .

*Primary Examiner*—Ramon O. Ramirez
*Assistant Examiner*—Stephen S. Wentsler
*Attorney, Agent, or Firm*—Horst M. Kasper

[57] ABSTRACT

A supporting frame structure is formed by two oppositely disposed and substantially identically shaped halves made of a bendable elastic material. Each half is made of a foil (1). The foil (1) contains about in the middle a round or square opening (2) and on one side an incision in the shape of a cutting line (3). The cutting line (3) extends radially from the edge of the foil to the opening (2). The two foils (1), disposed opposite to each other in parallel planes, are deformed by rotation of the cutting edges by about 90° out of the original foil plane in the direction of their counterpart. Subsequently, the in each case oppositely disposed cutting edges are connected to each other providing for a common, stable, and support-providing frame structure based on a mutually suspending winding tension of the two structure halves. The contours of the two openings (2) in their three-dimensional deformed shape provide the receiving and support for a body, where the shape and size of the body shows a direct relation to the shape and size of the opening (2).

27 Claims, 8 Drawing Sheets

SUPPORTING FRAME STRUCTURE AND METHOD FOR FORMING THIS FRAME STRUCTURE

BACKGROUND OF THE INVENTION

1. Field of the Invention

The commercial competition requires in all fields a continuous effort with respect to rationalization and effectiveness. A continuous requirement exists for a low-cost production of the respective product and of an efficient logistic of distribution and marketing. For example, this caused for example furnishing establishments to introduce series of furniture, which are produced as building block sets, which can be space-savingly transported, and which can then be set up and mounted by skilled personnel or by the end user.

2. Brief Description of the Background of the Invention Including Prior Art

This principle of component construction, however, encounters difficulties in case of furnishing items, where individual and complex three-dimensional forms are conventional or are desired for these furnishing items, for example, lamps or designer furniture.

The German printed patent document No. 196 25 381.0, filed Jun. 25, 1996 and having a equivalent U.S. Ser. No. 08/881,963 of the applicant teaches a method for the production of qualitatively high-value illuminating bodies, which can be formed in an easy way from a bendable elastic foil.

SUMMARY OF THE INVENTION

1. Purposes of the Invention

It is an object of the present invention to produce supporting frame structures having a complex three-dimensional shape, which are capable to receive or, respectively, to support various furnishing items, which supporting frame structures can be made of a qualitatively high-value material and are produced simply and economically and which are in addition advantageous to store and to transport.

These and other objects and advantages of the present invention will become evident from the description which follows.

2. Brief Description of the Invention

The present invention provides for an elastic frame structure. A first planar part, having a planar structure formed of a flat disk having a continuous periphery, has a first center opening and a first substantially radial overall straight cut connecting the continuous periphery to the center opening and defining a first end and a second end of the first planar part with a first middle section disposed between the first end and the second end. A second planar part, having a planar structure formed of a flat disk having a continuous periphery, has a second center opening and a second substantially radial overall straight cut connecting the continuous periphery to the center opening and defining a third end and a fourth end of the second planar part with a second middle section disposed between the third end and the fourth end. The first center opening is of sufficient size as to allow a bending of the first planar part such that tangential planes of the first end and of the second end are disposed perpendicular to tangential planes in the first middle section and such that a first face derived from a first side of the first planar part at the first end is disposed opposite to a second face derived from the first side of the first planar part at the second end of the first planar part. The second center opening is of sufficient size as to allow a bending of the second planar part such that tangential planes of the third end and of the fourth end are disposed perpendicular to tangential planes in the second middle section and such that a third face derived from a first side of the second planar part at the third end is disposed opposite to a fourth face derived from the first side of the second planar part at the fourth end of the second planar part. A first edge of the first end and a third edge of the third end are joined abutting together such that the tangential planes of the first planar part at the first end and of the second planar part at the third end substantially coincide. A second edge of the second end and a fourth edge of the fourth end are joined abutting together such that the tangential planes of the first planar part at the second end and of the second planar part at the fourth end substantially coincide.

An outer and an inner peripheral contour at the first end can be perpendicular to the first radial overall straight cut. An outer and an inner peripheral contour at the second end can be perpendicular to the first radial overall straight cut. An outer and an inner peripheral contour at the third end can be perpendicular to the second radial overall straight cut. An outer and an inner peripheral contour at the fourth end can be perpendicular to the second radial overall straight cut.

An outer peripheral contour at the first end of the first planar part can have a first distance from a center of the first center opening. An outer peripheral contour at the second end of the first planar part can substantially have the first distance from the center of the first center opening. An outer peripheral contour at the third end of the second planar part can substantially have the first distance from a center of the second center opening. An outer peripheral contour at the fourth end of the second planar part can substantially have the first distance from the center of the second center opening.

The first end and the third end can be connected by an overlay covering the first edge and the third edge. The overlay can be riveted to the first end and to the third end. The second end and the fourth end can be connected by an overlay covering the second edge and the fourth edge. The overlay can be riveted to the second end and to the fourth end.

There is further provided for a method for producing an elastic frame structure. A first planar part is formed having a planar structure formed of a flat disk having a continuous periphery, having a first center opening and having a first substantially radial overall straight cut connecting the continuous periphery to the center opening and defining a first end and a second end of the first planar part with a first middle section disposed between the first end and the second end. A second planar part is formed having a planar structure formed of a flat disk having a continuous periphery, having a second center opening and having a second substantially radial overall straight cut connecting the continuous periphery to the center opening and defining a third end and a fourth end of the second planar part with a second middle section disposed between the third end and the fourth end. The first planar part is bent such that the tangential planes of the first end and of the second end are disposed perpendicular to tangential planes in the first middle section and such that a first face derived from a first side of the first planar part at the first end is disposed opposite to a second face derived from the first side of the first planar part at the second end of the first planar part based on the first center opening being of a sufficient size as to allow such bending. The second planar part is bent such that the tangential planes of the third end and of the fourth end are disposed perpendicular to tangential planes in the second middle section and such that a third face derived from a first side of the second planar part at the third end is disposed opposite to a fourth face derived from the first side of the second planar part at the fourth end of the second planar part based on the second center opening being of a sufficient size as to allow such bending. A first edge of the first end is joined to a third edge of the third end abutting together such that the tangential planes of the first planar part at the first end and of the second planar part at the third end substantially coincide. A second edge of the second end is joined to a fourth edge of the fourth end abutting together such that the tangential planes of the first planar part at the second end and of the second planar part at the fourth end substantially coincide.

An elastic frame structure comprises a topological ring having a first surface and having a second surface and having an outer edge and having an inner edge. The outer edge provides an outer boundary for the first surface and for the second surface. The inner edge provides an inner boundary for the first surface and for the second surface. The outer boundary represents a steady continuous three dimensional curve. The inner boundary represents a steady continuous three dimensional curve. There exists continuously for each point of the outer boundary a defined corresponding point on the inner boundary disposed at a shortest relative distance between the outer point and the inner point. The maximum value of the shortest relative distances for all points on the outer boundary is less than 1.5 times the minimum value of the shortest relative distances for all points on the outer boundary.

The maximum value of the shortest relative distances for all points on the outer boundary can be less than 1.05 times the minimum value of the shortest relative distances for all points on the outer boundary.

A plurality of connected points on the outer boundary can correspond to a single defined point on the inner boundary.

The total length of the outer boundary can be from about the length of the inner boundary plus 12 times the minimum value of the shortest relative distances for all points on the outer boundary to about the length of the inner boundary plus 17 times the minimum value of the shortest relative distances for all points on the outer boundary.

The first surface and the second surface can be endless. The inner boundary and the outer boundary can be endless.

The inner surface and the outer surface can have a substantially identical shape after a rotary reflection of the elastic frame structure.

The present invention is based on the surprising recognition that such a frame structure can be formed in a simple manner from two oppositely disposed identically shaped halves, which comprise in each case a foil made of a bendable elastic material, which contains a round or square opening about in the center and which exhibits an incision on one side, where the incision leads radially from the foil edge to the opening. These two foils, disposed opposite to each other in parallel planes, are then deformed by rotation of the cut edges by about 90° out of the original foil plane into the direction of their counterpart, and in the following in each case the oppositely disposed cut edges are connected to each other, whereby a common, stable and supporting frame structure is generated, wherein the contours of the two openings in their three-dimensionally deformed shape form the receiver and support for a body, wherein the form and the size of said body is in a direct relationship to the form and size of the opening.

The formed stable frame form exhibits not only an aesthetically attractive and beautiful shape, but represents in addition a successful solution of static requirements in a functional way.

The frame structures according to the invention offer a series of essential advantages relative to comparable conventional frame structures:

a) The frame structures can be produced simply and economically based on the simple form of the foils to be employed.

b) The structure halves can be transported and stored in the form of a component set, which contains all required components, in particular the foils in their unbent and unmounted shape, in a safe way while saving at the same time space and packaging material.

c) The frame structures can be mounted and demounted with a few manual steps in case of a suitable selection of the kind of connection of their element halves.

Thus, all the objects presented are resolved by the frame structures according to the present invention.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
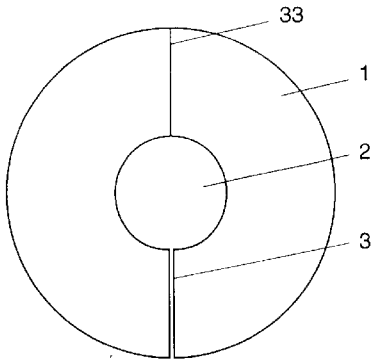
FIG. 1 shows a top view of a blank of a foil as a circular disk.

According to the present invention, there is provided for a supporting frame structure formed by two oppositely disposed and substantially identically shaped halves made of a bendable elastic material. Each half is made of a foil 1, wherein the foil 1 contains about in the middle a round or square opening 2 and on one side an incision in the shape of a cutting line 3. The cutting line 3 extends radially from the edge of the foil to the opening 2. These two foils 1, disposed opposite to each other in parallel planes, are deformed by rotation of the cutting edges by about 90° out of the original foil plane in the direction of their counterpart. Subsequently the in each case oppositely disposed cutting edges are connected to each other, whereby there is obtained a common, stable, and support-providing frame structure based on a mutually suspending winding tension of the two structure halves. The contours of the two openings 2 in their three-dimensional deformed shape provide the receiving and support for a body, where the shape and size of the body shows a direct relation to the shape and size of the opening 2.

The foil 1 can exhibit the shape of a rectangle, in particular of a square. The foil 1 can be a circular or an elliptical disk.

A segment can be cut off horizontally from the lower edge of the circular or elliptical disk 1 which contains the cutting line 3.

The opening 2 can exhibit the shape of a circle or of a rectangle.

The opening 2 can be disposed centered in the middle of the foil 1.

The ratio of the diameter of the opening 2 relative to the diameter of the foils 1 can amount to from about 1:2 to 1:4, and preferably about 1:3.

The cutting line 3 of each foil 1 can result in such shaped cutting edges that the cutting edges can be engaged in a stable way employing teeth matching corresponding recesses in the cutting edges of a respective opposite foil part.

The foil can be made of metal, in particular of hard-rolled V2A steel or of a steel with a comparably springing restoring force, of plastic, of reinforced plastic, or of bendable wood.

The body to be received by the frame structure can exhibit essentially the shape of a complete or incomplete sphere, of a complete or incomplete rotary ellipsoid, or of a cylinder.

The ratio of the horizontal diameter of the body, received by the frame structure, to the diameter of the foil opening 2 can amount to about a square root of two.

An inner contour of the frame forms a cage. A body disposed can be within the cage. The frame structure together with the body can furnish a member selected from the group consisting of a seating support furniture, a resting accommodation, a container, a lamp, or a bowl, or a combination thereof.

According to the present invention, there is also to be provided for a method for the shaping of a frame structure. Two substantially identical foils 1, made of a bendable, elastic material, include about in the middle a round or square opening 2 and exhibit on one side an incision in the shape of a cutting line 3. The cutting line 3 leads radially from the foil edge to the opening 2. Said two foils 1 are initially disposed in parallel planes relative to each other. The foils 1 are deformed by rotation of the cutting edges by about 90° out of the original foil plane into the direction of their counterpart. Subsequently, the respective oppositely disposed cutting edges are connected to each other such that there is generated a common stable structural form based on the mutually balancing winding tension of the two halves of the final structure.

A body with corresponding dimensions can be entered into the frame, which is delimited by the contours of the two openings 2 in their three-dimensional deformed shape. The form and size of the body can be in direct relation to the form and size of the opening 2 of the foil 1. The body is maintained in its position by the contours of the two openings 2 merged into a three dimensional contour surrounding the body.

FIG. 1 shows a circular disk with a centrically disposed circular opening 2 as a foil 1, which exhibits a straight cutting line 3.

The contour of the foil 1 of FIG. 1 represents an important parameter for the shape of the frame form to be formed. As a matter of principle, both round as well as square contour forms are suitable. Preferred are oval, elliptical, circular, and rectangular contours; particularly preferred are the shapes of a circle or of a square.

Figure 2:
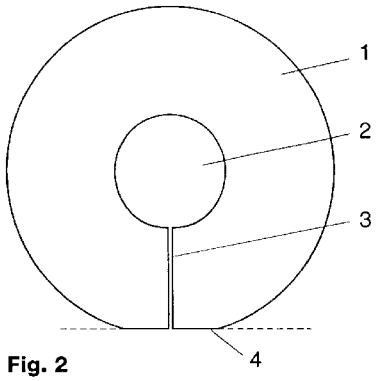
FIG. 2 shows the circular disk of FIG. 1, where a segment was cut from the lower edge of the disk.
Figure 3:
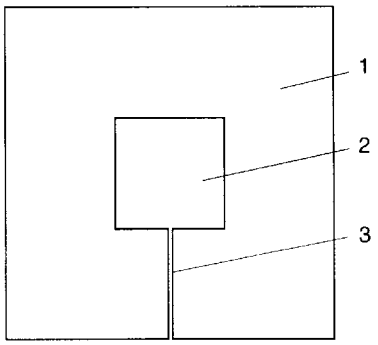
FIG. 3 shows a top view of a blank of a foil as a square disk having a square opening.
Figure 4:
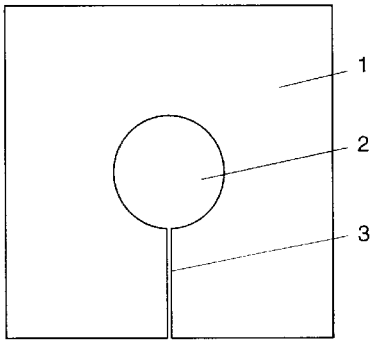
FIG. 4 shows a top view of a blank of a foil as a square disk having a circular opening.

FIG. 2 shows the circular disk of FIG. 1 with the difference that a segment has been cut off from the lower edge of the disk.

Even though round, in particular elliptical, contours also provide for a stable structural form, a segment can be cut off from the lower edge of a foil disk 1, as shown in FIG. 2, for obtaining still a higher stability.

Each material with the required bendable and elastic properties is suitable as a material for the foil 1. Preferred materials are metals, and in particular tough and elastic metals, for example V2A steel, bendable wood, for example wall panelling and wood veneer, plastics, and reinforced plastics, for example glass fiber reinforced plastics (GFK, GFP).

The thickness of the foil can vary over a wide range depending on the kinds of material employed, the size, and the intended use of the frame structure, for example for a table lamp, for a standing lamp, for a bowl, for a stool, for a table. The thickness of the foil is however usually in the range of 0.1 mm to 5 mm, and preferably from 0.2 to 2 mm. The thickness will depend also on the overall size of the structure. The overall diameter of the resulting structure can be from 100 to 500 times the thickness of the foil layer and is preferably from about 200 to 300 times the thickness of the foil layer.

The opening 2 is preferably centered in the middle of the foil.

The ratio of the diameter of the opening 2 to the outer diameter of the foils 1 amounts to about 1:2 to 1:8, and preferably from about 1:2 to 1:4, with a particularly preferred embodiment having a ratio of from about 1:2.8 to 1:3.2.

The cutting line 3, as shown in FIG. 1, which leads radially from the edge of the foil 1 to the opening 2, can run straight or not straight, i.e. for example, curved. Preferred are cutting lines which result in such forms of cut edges that they can reliably and stably lock with the cut edges of the respective foil counterpart. The cutting line can be at an angle of up to about 45° and at an angle of less than 20° and more preferably, at an angle of less than 2° relative to a straight radial line. The angular distance of the ends of a flat cut foil with a center opening are less than about 60°, preferably less than about 30°, and more preferably less than 5°. The topological configuration of the invention structure in that it exhibits two surfaces instead of the single surface of a Möbius band.

Figure 5:
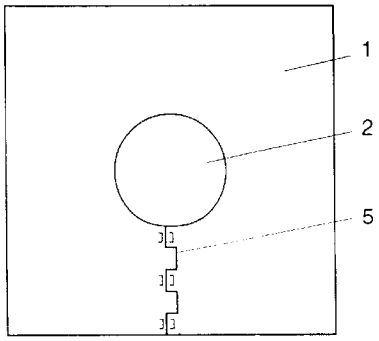
FIG. 5 shows the square disk of FIG. 4, where the cutting edges are furnished with locking noses.

FIG. 5 shows a foil with a stepped cutting line 5, which stepped cutting line in addition exhibits locking noses 6 for a more stable tooth engagement of the cutting edges.

Figure 7:
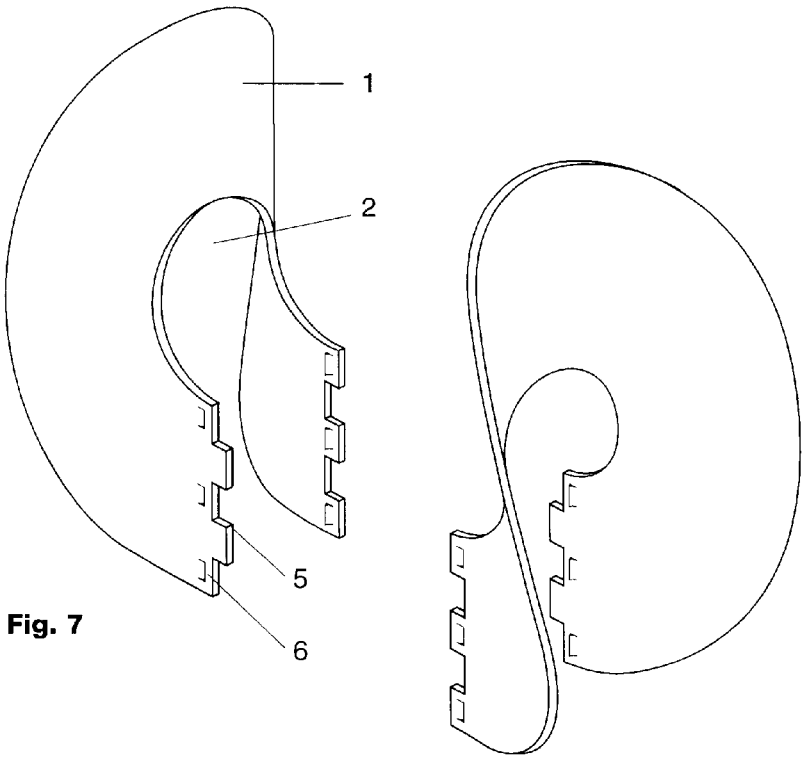
FIG. 7 shows two square disks according to FIG. 5, deformed and ready for assembly by means of the locking noses.

A stable locking of the cut edges can for example be obtained by wave-shaped, toothed, or stepped cutting lines 5, as shown in FIGS. 5 and 7. For obtaining a more stable tooth engagement, the cutting edges can furthermore be furnished with locking noses 6, as shown in FIGS. 5 and 7.

A more stable tooth engagement can also be achieved in that an adhesive strip is applied to the stepped cutting lines of the planar foil, where a protective cover layer is removed from the adhesive strip at the time of assembly, and in particular a double-faced adhesive strip between the teeth and the other end of the form structure.

Figure 6:
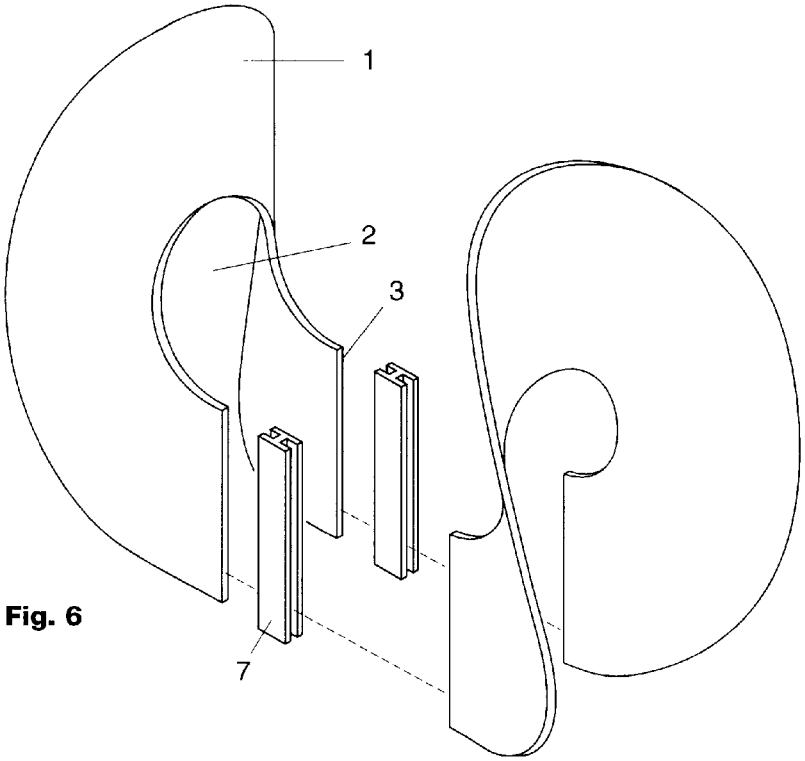
FIG. 6 shows two deformed circular disks to be assembled by means of a clamping piece.

FIG. 6 shows two already deformed structure halves, disposed opposite to each other, having smooth cutting edges as well as two plug or clamping pieces 7, having an H shaped cross-section for connecting the cutting edges.

The connection of the cutting edges can also be furnished by means of a rear supported or rear underlaid rivet or screw connection, by way of the plug or clamping pieces 7 having preferably an H shaped cross section, as shown in FIG. 6, and/or by welding or gluing.

According to one embodiment, the structure halves are composed of two or more part sections connected to each other. It is essential in this context that the connection between these part sections is stable in such a way that it allows a stable deformation of the structure halves to the described structural form.

The form and the size of the opening 2 are in direct relationship to the form and size of the body to be received by the frame structure. The ratio of the horizontal diameter of the body, received by the frame structure, to the diameter of the foil opening 2 amounts therewith exactly or approximately to a square root of 2.

Rectangular or square openings 2 result in frame structures which are suitable for the receiving of parallelepipedal, cuboid or cylindrical bodies.

Particularly preferred are circular openings 2. The circular openings 2 result in an enveloping curve which is suited in an ideal way for the receiving of a spherical body. The generated enveloping curve runs then, expressed comparatively, like the seam line of a tennis ball.

The above enveloping curve is however also very suitable for the receiving of an incomplete sphere or of a complete or incomplete rotary ellipsoid.

The support capability of such enveloping curves, where the form stability rests only on the inner tension, is surprisingly high.

According to a preferred embodiment, the body received by the frame structure is an illuminating means. Suitable illuminating means comprise for example conventional light bulbs, halogen lamps, energy-saving lamps, or low-voltage illuminating bodies as well as socket and support frame, as well as possibly a diffuser.

Figure 8:
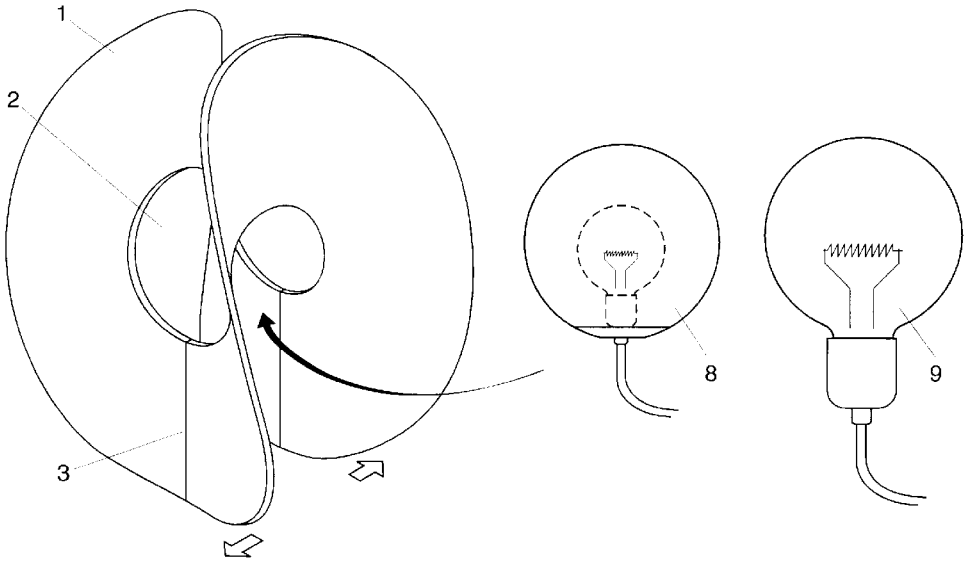
FIG. 8 shows two circular disks assembled to a frame structure and ready to receive an illuminating means.
Figure 9:
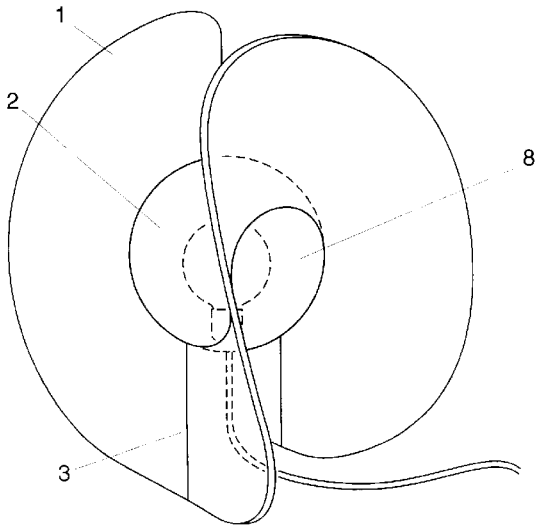
FIG. 9 shows the assembled frame structure of FIG. 8 with the mounted illuminating means.

FIG. 8 shows a completely mounted frame structure, ready for receiving a spherical illuminating means and made of foils 1 having a circular contour, as well as two variations of such illuminating means 8, 9. FIG. 9 shows a frame structure after receiving the illuminating means 8.

Figure 10:
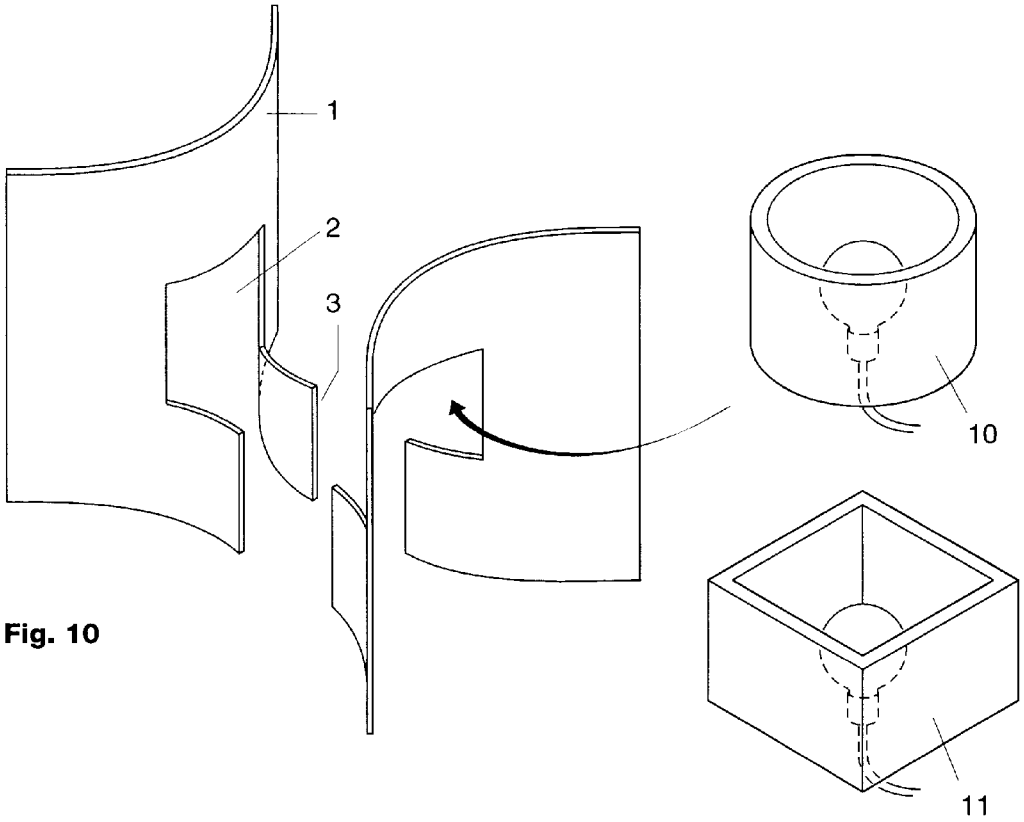
FIG. 10 shows two square disks according to FIG. 3, deformed and ready for assembly to form a frame structure and to receive an illuminating means.
Figure 11:
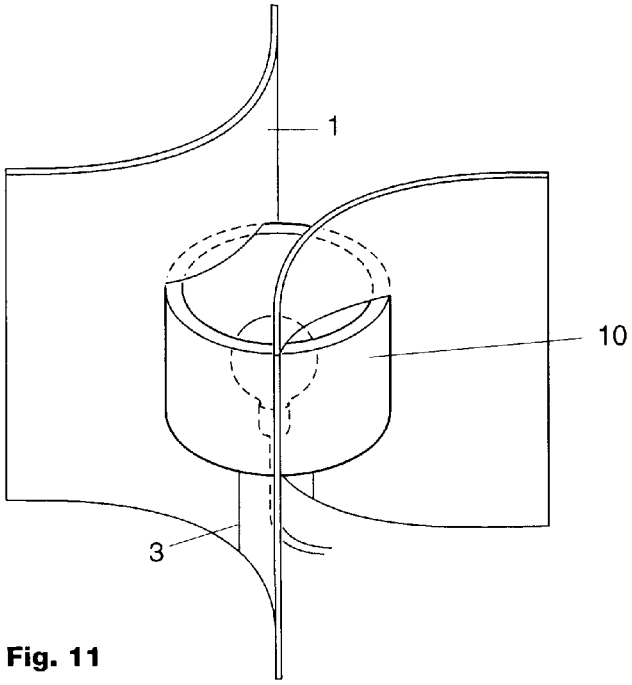
FIG. 11 shows the frame structure formed according to FIG. 10 with mounted illuminating means.

FIG. 10 shows two oppositely disposed structure halves, made of foils having a square contour, which are intended for the receiving of a cylinder-shaped or, respectively, a parallelepipedal or cuboid body, as well as corresponding bodies which in each case include an illuminating means 10, 11. FIG. 11 shows the frame structure of FIG. 10 after receiving the cylindrical body which includes an illuminating means 10.

Figure 12:
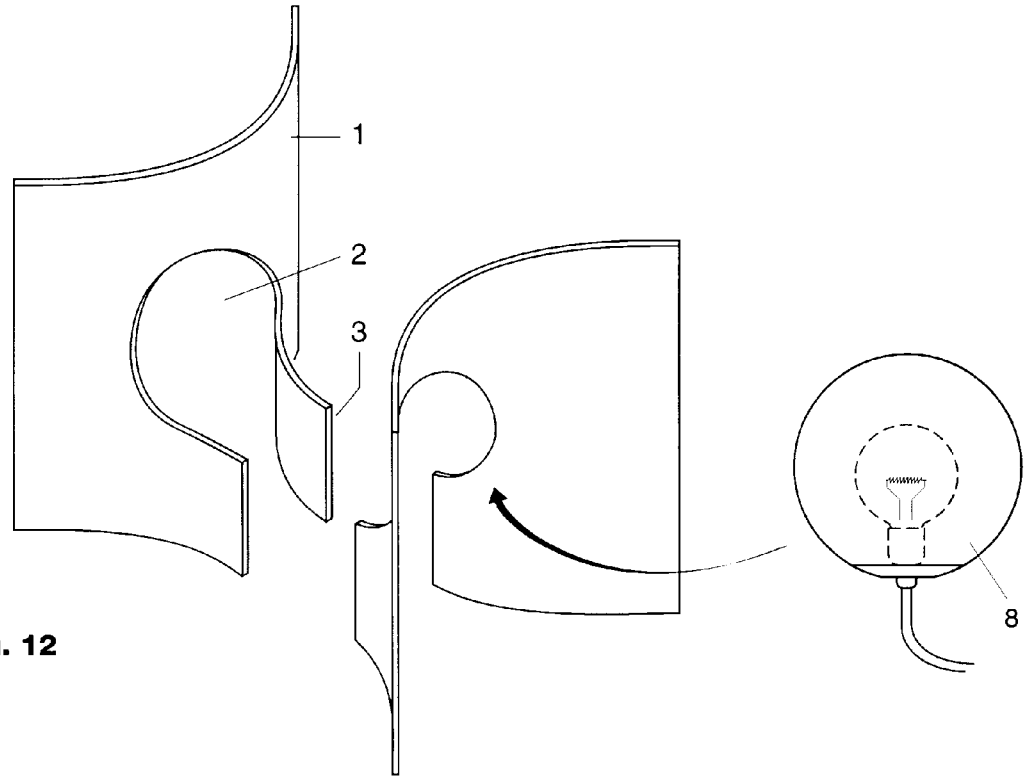
FIG. 12 shows two square disks according to FIG. 4, deformed and ready for assembly to form a frame structure and to receive an illuminating means.
Figure 13:
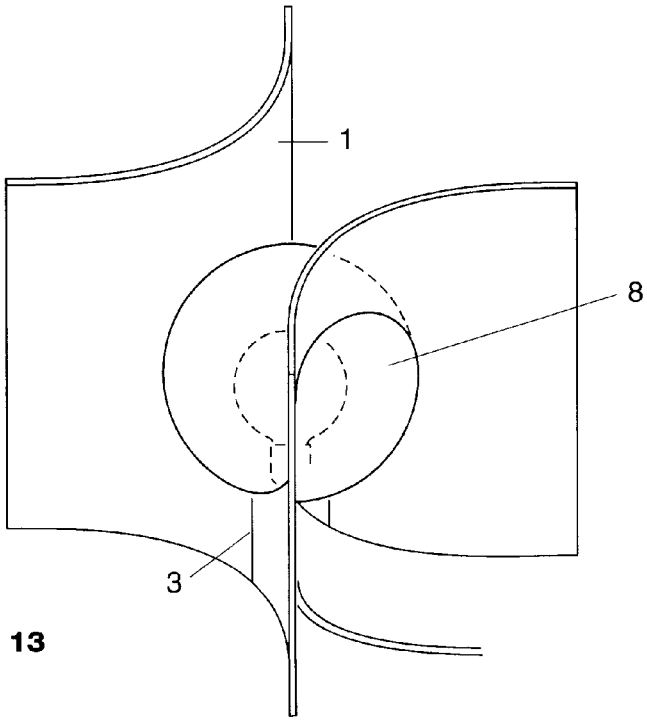
FIG. 13 shows the frame structure formed according to FIG. 12 with mounted illuminating means.

A frame structure which receives a spherical illuminating means 8 is shown in FIG. 12. FIG. 13 shows the frame structure of FIG. 12 after receiving the spherical illuminating means 8.

The spherical illuminating means rests in the cage provided by the opening 2. No fastening means is necessary at the spherical illuminating means for maintaining the spherical illuminating means in the cage of the frame structure of the present invention.

Figure 14:
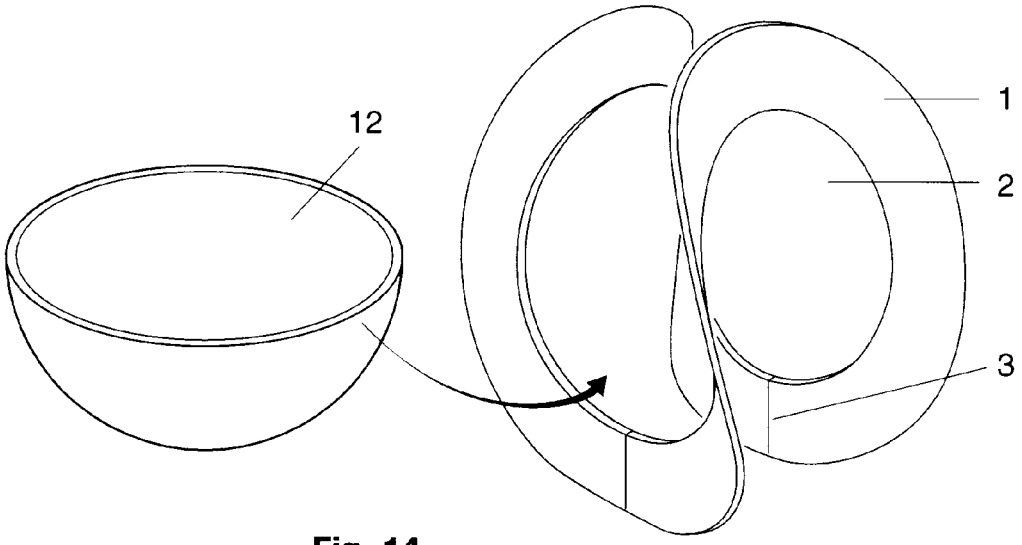
FIG. 14 shows a frame structure ready to receive a bowl.
Figure 15:
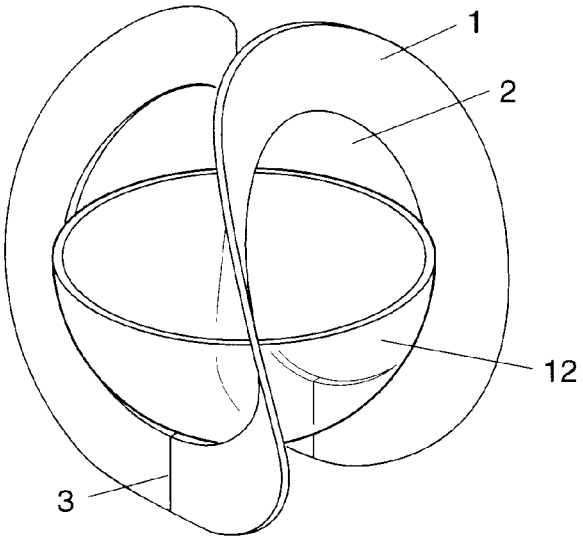
FIG. 15 shows the frame structure of FIG. 14 with the mounted bowl.

A further embodiment of a frame structure is shown in FIG. 14, where the frame structure is assembled and ready to receive a bowl 12. FIG. 15 shows the frame structure of FIG. 14 after receiving the bowl 12.

In each case, two invention frame structures are preferably identical to each other and can be produced with only one inexpensive punch pressing or stamping. Carbon spring steel or glass/carbon fiber plastic composite materials are preferably produced by water jet or laser beam cutting.

As already recited above, the frame structures according to the invention can be transported and stored easily and advantageously in the shape of a component set. Such a component set for a lamp can contain:

a) two or more foils 1 with an opening 2 and a cutting line 3;

b) an illuminating means, possibly also including a diffuser;

c) required means for connecting the cutting edges, such as for example plug or clamping pieces;

d) a connection cable or another device for the power supply, which is preferably already connected to the illuminating means and ready for operation;

e) possibly means for the regulation of the light intensity and/or of the power supply, transformers, ignition power supply units or the like.

The resulting combined structure, under neglecting of the specific connection means at the joining of the ends of the two planar foils as long as the joining results in a planar connection of the respective ends after assembly, shows substantially a fourfold mirror rotation symmetry. The fourfold mirror symmetry axis is disposed substantially parallel to the adjoining cut edges at the ends of the planar foils and parallel to a radial line 33 disposed in the middle of the planar foil on the opposite side of where the cutting line 3 is disposed. A rotation of 90 degrees around this fourfold mirror symmetry axis plus a reflection on a mirror plane, disposed perpendicular to this axis, representing a rotary reflection, thereby transforms the combined structure essentially into itself. In addition, as long as the planar foils exhibit a mirror plane aligned with the cutting line, the combined structure includes in addition two mirror planes mutually intersecting along a twofold rotation axis of the combined structure. The fourfold mirror symmetry axis will be present as long as the planar foil exhibits substantially two mirror planes disposed perpendicular relative to each other and neglecting the cutting line 3.

As stated above, only the cutting edges of the foils are to be connected. The result of the assembly is not a vague, arbitrary form, but rather a defined course of physical/mechanical principles. This course can also be supported with a mathematical function as a continuous three-dimensional curve. Based on the connection of the oppositely disposed cutting edges, the foils with the material-inherent spring force can no longer return into the planar initial position. The mutual spring forces of the foils are canceled based on the connection of the cutting edges, based on the equilibrium of the force; in other words, a new material-dynamic behavior results from the now prevailing and acting alternating load of bending tension and torsion. The permanently acting spring force remains guided in this "endless loop" and acts now form-stabilizingly on the common, stable and supporting frame structure made out of two foil elements. Based on this, the spring force, generated during the method for deformation can be utilized two-fold. First, for the form stabilization of the supporting structure and, secondly, as a support force for example for an inserted light diffuser ball. In this case, the inner contour of the frame structure in part surrounds the clipped-in ball as an enveloping curve, or like the seam line of a tennis ball, and wherein the inner contour firmly holds the clipped-in ball like a snap-lock element in a defined position, thereby eliminating any additional attachment elements.

The long-term behavior of the spring force of reinforced plastics has been tested over decades and is known as reliable, for example in airplane construction, with type 1.4310 stainless steel in, for example, wind-up mechanics of seat belts.

A test series with different materials and various sizes resulted in that the diameter of the foil opening of a square root of two equal to a value of about 1.41 results in the ideal diameter of the clipped-in rotary figure, cylinder, etc. As an example, if the diameter of the foil opening amounts to 7.07 cm, the corresponding diffuser ball has a diameter of 10 cm. For harmonization of the partial enveloping curve, the lateral axis is stretched by 10%.

An approximately circular-shaped opening describes the geometrical form which assures a very precise enveloping curve based on an ellipse of 100% in the horizontal axis and of 110% in the lateral axis.

The resulting combined structure will exhibit substantially a cage defined by the joined inner edges of the opening 2. In case of a circular opening or of an elliptical opening, the resulting structure will be particularly adapted to support a spherical or rotation elliptical body inside the combined structure. If the opening 2 of the planar foil is rectangular, then the cage will be particularly adapted to support a body exhibiting cylindrical features inside of the cage. Depending on the elasticity conditions, the body can be inserted into the cage of the combined structure either before joining the two planar foils to a single three-dimensional structure or after assembling a three-dimensional structure if the elasticity of the combined structure will still allow this.

Correspondingly modified component sets can also be assembled, composed, and configured without difficulty for other furnishing objects.

Figure 16:
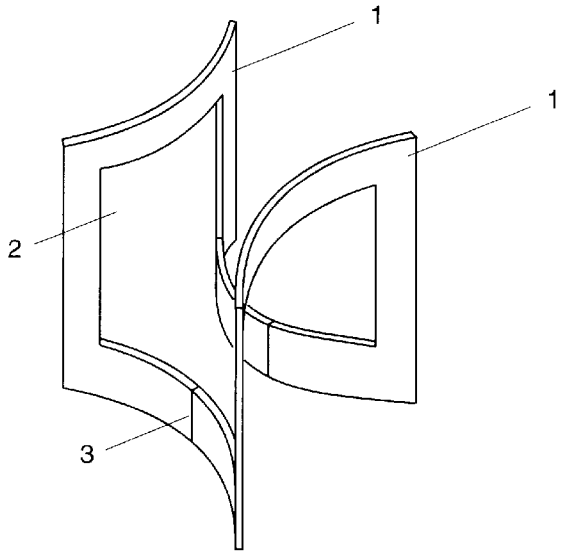
FIG. 16 shows two square disks, similar to the disk of FIG. 3, assembled to a frame structure.
Figure 17:
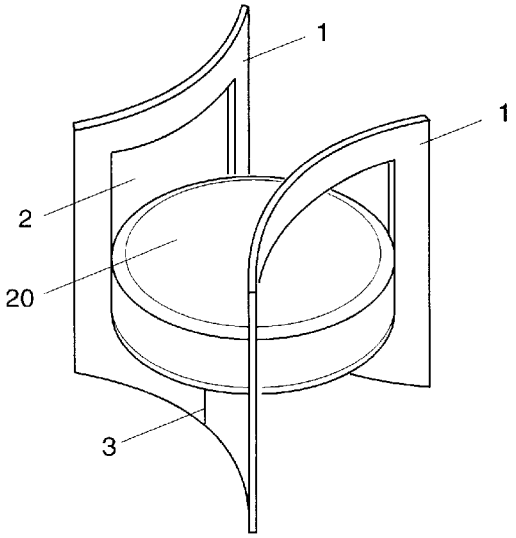
FIG. 17 shows the frame structure of FIG. 16 with a mounted seat and furnishing a chair or stool.

For example, a round seat cushion 3 can be inserted into the assembled frame structure of FIG. 16 to provide for a stool, a chair, or the like, as shown in FIG. 17.

Figure 18:
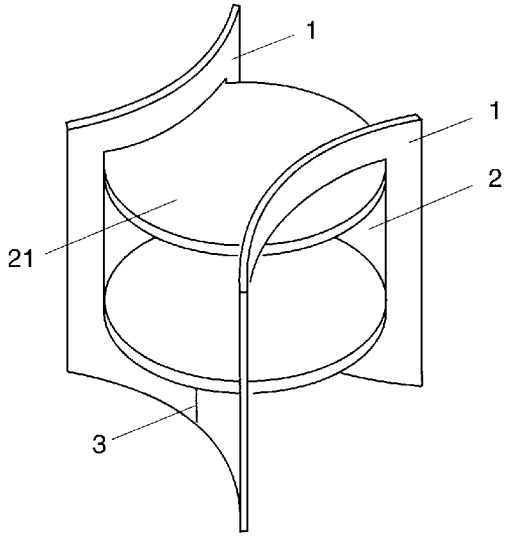
FIG. 18 shows the frame structure of FIG. 16 with two mounted shelves and furnishing a sideboard or side table.

According to FIG. 18, round shelves 21 are mounted into the frame structure of FIG. 16, thereby furnishing, for example, a sideboard or side table.

Figure 19:
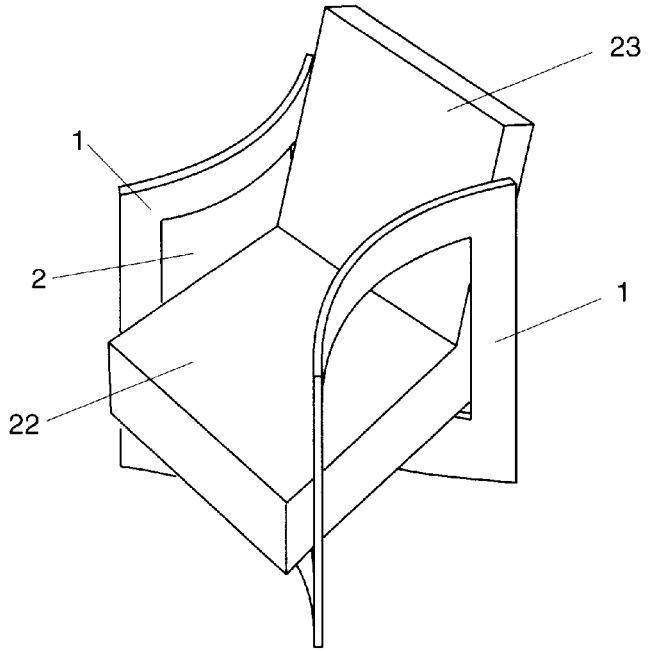
FIG. 19 shows the frame structure of FIG. 16 with a mounted seating surface and backrest and furnishing an armchair.

A backrest 23 and a seating surface 22 are mounted into the frame structure of FIG. 16, thereby furnishing an armchair according to FIG. 19.

Figure 20:
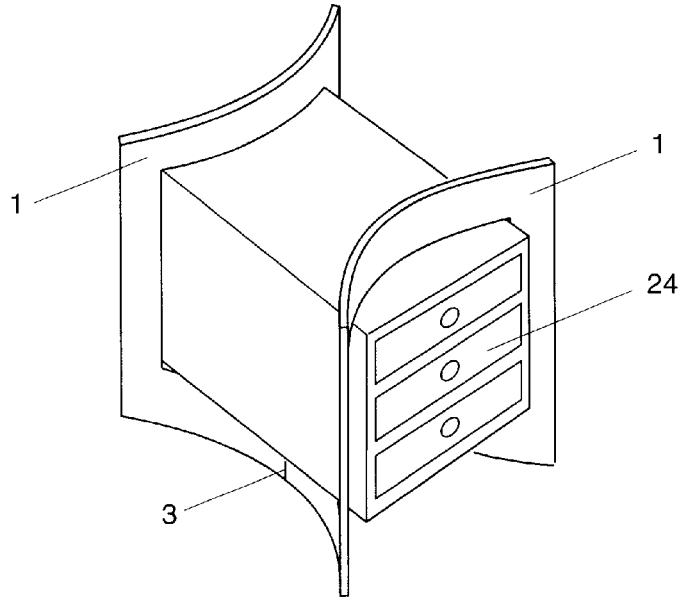
FIG. 20 shows the frame structure of FIG. 16 with mounted drawers and furnishing a chest of drawers.

It is also possible according to FIG. 20 to mount a set of drawers into the frame structure of FIG. 16, thereby furnishing a chest of drawers serving, for example, as a night table, a tea trolley, a hall table, a dresser, a vanity, etc.

A method with the features for forming a frame structure as defined above is also an object of the present invention.

It will be understood that each of the elements described above, or two or more together, may also find a useful application in other types of frame structures differing from the types described above.

While the invention has been illustrated and described as embodied in the context of a supporting frame structure and a method for forming this frame structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An elastic frame structure comprising a first planar part having a planar structure formed of a flat disk having a continuous periphery, having a first center opening and having a first substantially radial overall straight cut connecting the continuous periphery to the center opening and defining a first end and a second end of the first planar part with a first middle section disposed between the first end and the second end;

a second planar part having a planar structure formed of a flat disk having a continuous periphery, having a second center opening and having a second substantially radial overall straight cut connecting the continuous periphery to the center opening and defining a third end and a fourth end of the second planar part with a second middle section disposed between the third end and the fourth end;

wherein the first center opening is of sufficient size as to allow a bending of the first planar part such that tangential planes of the first end and of the second end are disposed perpendicular to tangential planes in the first middle section and such that a first face derived from a first side of the first planar part at the first end is disposed opposite to a second face derived from the first side of the first planar part at the second end of the first planar part;

wherein the second center opening is of sufficient size as to allow a bending of the second planar part such that tangential planes of the third end and of the fourth end are disposed perpendicular to tangential planes in the second middle section and such that a third face derived from a first side of the second planar part at the third end is disposed opposite to a fourth face derived from the first side of the second planar part at the fourth end of the second planar part;

wherein a first edge of the first end and a third edge of the third end are joined abutting together such that the tangential planes of the first planar part at the first end and of the second planar part at the third end substantially coincide;

wherein a second edge of the second end and a fourth edge of the fourth end are joined abutting together such that the tangential planes of the first planar part at the second end and of the second planar part at the fourth end substantially coincide.

2. The elastic frame structure according to claim 1, wherein an outer peripheral contour at the first end is perpendicular to the first radial overall straight cut, wherein an outer peripheral contour at the second end is perpendicular to the first radial overall straight cut, wherein an outer peripheral contour at the third end is perpendicular to the second radial overall straight cut, and wherein an outer peripheral contour at the fourth end is perpendicular to the second radial overall straight cut.

3. The elastic frame structure according to claim 1, wherein an outer peripheral contour at the first end of the first planar part has a first distance from a center of the first center opening;

wherein an outer peripheral contour at the second end of the first planar part has substantially the first distance from the center of the first center opening;

wherein an outer peripheral contour at the third end of the second planar part has substantially the first distance from a center of the second center opening; and wherein an outer peripheral contour at the fourth end of the second planar part has substantially the first distance from the center of the second center opening.

4. The elastic frame structure according to claim 1, wherein the first end and the third end are connected by an overlay covering the first edge and the third edge and wherein the overlay is riveted to the first end and to the third end; and wherein the second end and the fourth end are connected by an overlay covering the second edge and the fourth edge and wherein the overlay is riveted to the second end and to the fourth end.

5. The elastic frame structure according to claim 1, wherein an inner peripheral contour at the first end is perpendicular to the first radial overall straight cut, wherein an inner peripheral contour at the second end is perpendicular to the first radial overall straight cut, wherein an inner peripheral contour at the third end is perpendicular to the second radial overall straight cut, and wherein an inner peripheral contour at the fourth end is perpendicular to the second radial overall straight cut.

6. A supporting frame structure formed by two oppositely disposed and substantially identically shaped halves made of a bendable elastic material, wherein each half is made of a foil (1) , wherein the foil (1) contains about in the middle a round or square opening (2) and on one side an incision in the shape of a cutting line (3), which cutting line (3) extends radially from the edge of the foil to the opening (2), and wherein these two foils (1), disposed opposite to each other in parallel planes, are deformed by rotation of the cutting edges by about 90° out of the original foil plane in the direction of their counterpart, and wherein subsequently the in each case oppositely disposed cutting edges are connected to each other, whereby a common, stable, and support-providing frame structure based on a mutually suspending winding tension of the two structure halves is obtained, wherein the contours of the two openings (2) in their three-dimensional deformed shape provide the receiving and support for a body, where the shape and size of the body shows a direct relation to the shape and size of the opening (2).

7. The frame structure according to claim 6, wherein the foil (1) exhibits the shape of a rectangle, in particular of a square.

8. The frame structure according to claim 7, wherein a segment is cut off horizontally from the lower edge of the circular or elliptical disk (1) which contains the cutting line (3).

9. The frame structure according to claim 6, wherein the foil (1) is a circular or an elliptical disk.

10. The frame structure according to claim 6, wherein the opening (2) exhibits the shape of a circle or of a rectangle.

11. The frame structure according to claim 6, wherein the opening (2) is disposed centered in the middle of the foil (1).

12. The frame structure according to claim 6, wherein the ratio of the diameter of the opening (2) relative to the diameter of the foils (1) amounts to from about 1:2 to 1:4, and preferably about 1:3.

13. The frame structure according to claim 6, wherein the cutting line (3) of each foil (1) results in such shaped cutting edges that the cutting edges can be engaged in a stable way employing teeth matching corresponding recesses in the cutting edges of a respective opposite foil part.

14. The frame structure according to claim 6, wherein the foil is made of metal, in particular of hard-rolled V2A steel or of a steel with a comparably springing restoring force, of plastic, of reinforced plastic, or of bendable wood.

15. The frame structure according to claim 6, wherein the body to be received by the frame structure exhibits essentially the shape of a complete or incomplete sphere, of a complete or incomplete rotary ellipsoid, or of a cylinder.

16. The frame structure according to claim 6, wherein the ratio of the horizontal diameter of the body, received by the frame structure, to the diameter of the foil opening (2) amounts to about a square root of 2.

17. The frame structure according to claim 6, wherein an inner contour of the frame forms a cage, and further comprising a body disposed within the cage, wherein the frame structure together with the body furnishes a member selected from the group consisting of a seating support furniture, a resting accommodation, a container, a lamp, or a bowl, or a combination thereof.

18. The frame structure according to claim 6, wherein each of the substantially identically shaped halves is comprised of at least two component parts, wherein a connection between these component parts is furnished suitable for obtaining a stable deformation of the substantially identically shaped halves and therewith a support-providing frame structure.

19. A method for producing an elastic frame structure comprising forming a first planar part having a planar structure formed of a flat disk having a continuous periphery, having a first center opening and having a first substantially radial overall straight cut connecting the continuous periphery to the center opening and defining a first end and a second end of the first planar part with a first middle section disposed between the first end and the second end;

forming a second planar part having a planar structure formed of a flat disk having a continuous periphery, having a second center opening and having a second substantially radial overall straight cut connecting the continuous periphery to the center opening and defining a third end and a fourth end of the second planar part with a second middle section disposed between the third end and the fourth end;

bending the first planar part such that the tangential planes of the first end and of the second end are disposed perpendicular to tangential planes in the first middle section and such that a first face derived from a first side of the first planar part at the first end is disposed opposite to a second face derived from the first side of the first planar part at the second end of the first planar part based on the first center opening being of a sufficient size as to allow such bending;

bending the second planar part such that the tangential planes of the third end and of the fourth end are disposed perpendicular to tangential planes in the second middle section and such that a third face derived from a first side of the second planar part at the third end is disposed opposite to a fourth face derived from the first side of the second planar part at the fourth end of the second planar part based on the second center opening being of a sufficient size as to allow such bending;

joining a first edge of the first end and a third edge of the third end abutting together such that the tangential planes of the first planar part at the first end and of the second planar part at the third end substantially coincide;

joining a second edge of the second end and a fourth edge of the fourth end abutting together such that the tangential planes of the first planar part at the second end and of the second planar part at the fourth end substantially coincide.

20. A method for the shaping of a frame structure, wherein two substantially identical foils (1), made of a bendable, elastic material, include about in the middle a round or square opening (2) and exhibit on one side an incision in the shape of a cutting line (3), which cutting line (3) leads radially from the foil edge to the opening (2), wherein said two foils (1) are initially disposed in parallel planes relative to each other, wherein the foils (1) are deformed by rotation of the cutting edges by about 90° out of the original foil plane into the direction of their counterpart, and wherein subsequently the respective oppositely disposed cutting edges are connected to each other such that there is generated a common stable structural form based on the mutually balancing winding tension of the two halves of the final structure.

21. The method for the shaping of a frame structure according to claim 20, further comprising entering a body with corresponding dimensions into the frame, which is delimited by the contours of the two openings (2) in their three-dimensional deformed shape, wherein the form and size of the body is in direct relation to the form and size of the opening (2) of the foil (1), and wherein the body is maintained in its position by the contours of the two openings (2) merged into a three dimensional contour surrounding the body.

22. An elastic frame structure comprising a topological ring having a first surface and having a second surface and having an outer edge and having an inner edge, wherein the outer edge provides an outer boundary for the first surface and for the second surface, wherein the inner edge provides an inner boundary for the first surface and for the second surface, wherein the outer boundary represents a steady continuous three dimensional curve;

wherein the inner boundary represents a steady continuous three dimensional curve;

wherein there exists continuously for each point of the outer boundary a defined corresponding point on the inner boundary disposed at a shortest relative distance between the outer point and the inner point, wherein the maximum value of the shortest relative distances for all points on the outer boundary is less than 1.5 times the minimum value of the shortest relative distances for all points on the outer boundary.

23. The elastic frame structure according to claim 22, wherein the maximum value of the shortest relative distances for all points on the outer boundary is less than 1.05 times the minimum value of the shortest relative distances for all points on the outer boundary.

24. The elastic frame structure according to claim 22, wherein a plurality of connected points on the outer boundary correspond to a single defined point on the inner boundary.

25. The elastic frame structure according to claim 22, wherein the total length of the outer boundary is from about the length of the inner boundary plus 12 times the minimum value of the shortest relative distances for all points on the outer boundary to about the length of the inner boundary plus 17 times the minimum value of the shortest relative distances for all points on the outer boundary.

26. The elastic frame structure according to claim 22, wherein the first surface is endless, wherein the second surface is endless, wherein the inner boundary is endless and wherein the outer boundary is endless.

27. The elastic frame structure according to claim 22, wherein the inner surface and the outer surface have a substantially identical shape after a rotary reflection of the elastic frame structure.

* * * * *